US011467538B2

(12) United States Patent
Funakawa et al.

(10) Patent No.: US 11,467,538 B2
(45) Date of Patent: Oct. 11, 2022

(54) WATCH COMPONENT, MOVEMENT AND WATCH

(71) Applicant: Seiko Epson Corporation, Tokyo (JP)

(72) Inventors: Takeo Funakawa, Chino (JP); Munehiro Shibuya, Minamiminowa (JP)

(73) Assignee: Seiko Epson Corporation

( * ) Notice: Subject to any disclaimer, the term of this patent is extended or adjusted under 35 U.S.C. 154(b) by 571 days.

(21) Appl. No.: 16/538,949

(22) Filed: Aug. 13, 2019

(65) Prior Publication Data

US 2020/0057412 A1 Feb. 20, 2020

(30) Foreign Application Priority Data

Aug. 14, 2018 (JP) ..... JP2018-152705

(51) Int. Cl.
*G04B 15/14* (2006.01)

(52) U.S. Cl.
CPC ..... *G04B 15/14* (2013.01)

(58) Field of Classification Search
CPC .... G04D 3/0069; G04B 15/14; G04B 17/063; G04B 17/06; G04F 7/088
See application file for complete search history.

(56) References Cited

U.S. PATENT DOCUMENTS

| | | | | |
|---|---|---|---|---|
| 3,738,101 | A * | 6/1973 | Simon-Vermot | G04B 17/066 368/125 |
| 8,591,101 | B2 * | 11/2013 | Hiraoka | G04B 15/14 368/132 |
| 9,015,921 | B2 * | 4/2015 | Queval | G04B 15/14 29/527.1 |
| 9,098,067 | B2 * | 8/2015 | Koda | G04B 15/14 |
| 10,747,177 | B2 * | 8/2020 | Shibuya | G04B 15/14 |
| 10,747,178 | B2 * | 8/2020 | Shibuya | G04B 13/02 |
| 10,761,483 | B2 * | 9/2020 | Shibuya | G04B 13/026 |
| 2009/0263182 | A1 | 10/2009 | Bannier et al. | |
| 2012/0243386 | A1 * | 9/2012 | Semon | G04B 17/063 368/125 |
| 2016/0266549 | A1 * | 9/2016 | Stranczl | G04B 17/32 |

FOREIGN PATENT DOCUMENTS

| | | | |
|---|---|---|---|
| JP | 2009-265097 A | 11/2009 | |
| JP | 2016-061775 A | 4/2016 | |
| JP | 2017-044487 A | 3/2017 | |
| WO | WO-2012127016 A1 * | 9/2012 | G04B 17/06 |

* cited by examiner

*Primary Examiner* — Edwin A. Leon
(74) *Attorney, Agent, or Firm* — Harness, Dickey & Pierce, P.L.C.

(57) ABSTRACT

A watch component includes a shaft member including a shaft and a flange portion formed to protrude in a direction intersecting with an axial direction of the shaft, a body portion made of silicon and provided with an insertion hole through which the shaft is inserted, and a fixing member mounted on the shaft at a side of the body portion opposite from the flange portion. The body portion includes an accommodating recessed portion configured to accommodate the flange portion, and is fixed to the shaft member by being interposed between the flange portion and the fixing member.

7 Claims, 17 Drawing Sheets

WATCH COMPONENT, MOVEMENT AND WATCH

The present application is based on, and claims priority from, JP Application Serial Number 2018-152705, filed Aug. 14, 2018, the disclosure of which is hereby incorporated by reference herein in its entirety.

BACKGROUND

1. Technical Field

The present disclosure relates to a watch component, a movement, and a watch.

2. Related Art

A mechanical watch is equipped with a large number of watch components, typified by gears and the like. In the related art, watch components are formed by machining a metal material. However, in recent years, a substrate containing silicon has been used as a material of watch components (see, for example, JP-A-2017-44487).

In JP-A-2017-44487, a pallet body that is a body portion of a pallet fork used in an escapement mechanism of a mechanical watch, is formed using a semiconductor process technology. This allows the shape of the pallet body to be precisely processed.

In the pallet fork of JP-A-2017-44487, a pallet staff is loosely fitted into a hole formed in the pallet body, and the pallet body is positioned relative to the axial direction of the pallet staff. Then, the pallet body and the pallet staff are fixed together with an adhesive. In this case, there is a problem in that assembly of the pallet fork is difficult because a very small amount of adhesive needs to be applied to the pallet body and the pallet staff, which are very small components.

SUMMARY

A watch component of the present disclosure includes a shaft member including a shaft and a flange portion formed to protrude in a direction intersecting with an axial direction of the shaft, and a body portion made of silicon and provided with an insertion hole through which the shaft is inserted, and a fixing member mounted on the shaft at a side of the body portion opposite from the flange portion. The body portion includes an accommodating recessed portion configured to accommodate the flange portion, and is fixed to the shaft member by being interposed between the flange portion and the fixing member.

A watch component of the present disclosure includes a shaft member including a shaft and a flange portion formed to protrude in a direction intersecting with an axial direction of the shaft, and a body portion made of silicon and provided with an insertion hole through which the shaft is inserted, and a fixing member mounted on the shaft at a side of the body portion opposite from the flange portion. The body portion includes an accommodating recessed portion configured to accommodate the fixing member, and is fixed to the shaft member by being interposed between the flange portion and the fixing member.

In the watch component of the present disclosure, the body portion may include a holding portion configured to protrude into the insertion hole and to be elastically deformable in the direction intersecting with the axial direction of the shaft, and the body portion and the shaft member may be positioned by interposing the shaft between the holding portion and a wall surface of the insertion hole.

In the watch component of the present disclosure, the shaft member may be a pallet staff, and the body portion may be a pallet body including a pallet arm and a pallet rod.

A movement of the present disclosure includes the above-described watch component.

A watch of the present disclosure includes the above-described movement.

DESCRIPTION OF EXEMPLARY EMBODIMENTS

First Embodiment

First Embodiment of the present disclosure will be described below with reference to the drawings.

Figure 1:
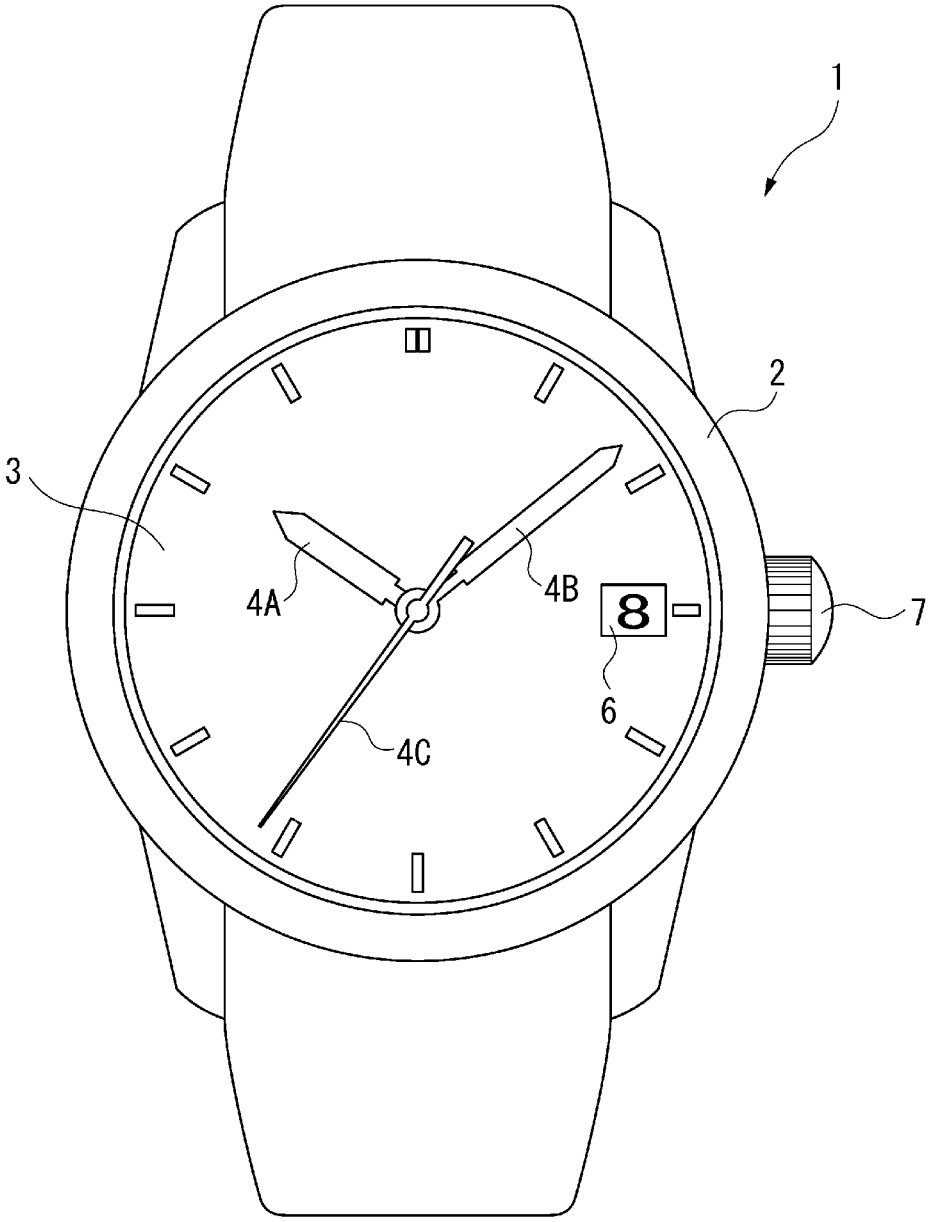
FIG. 1 is a front view illustrating a watch of First Embodiment of the present disclosure.
Figure 2:
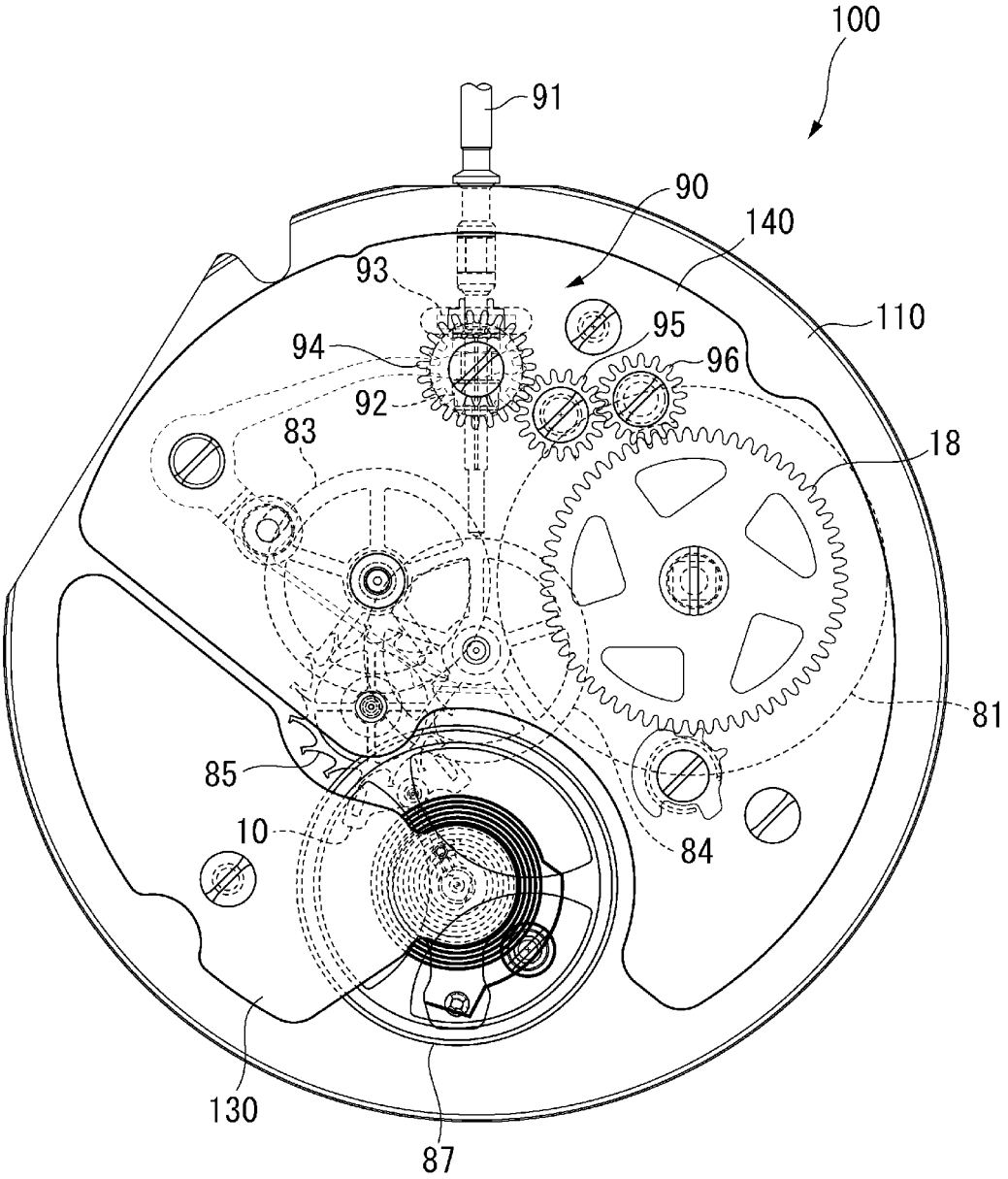
FIG. 2 is a diagram illustrating a movement of First Embodiment.

Movement and Watch FIG. 1 is a front view of a watch 1 of the present embodiment, and FIG. 2 is a diagram of a movement 100 as viewed from a case back side.

The watch 1 is configured to be mounted on a wrist of a user. The watch 1 includes an outer packaging case 2, and a dial 3, an hour hand 4A, a minute hand 4B, a seconds hand 4C, and a day indicator 6 provided in the outer packaging case 2, and further includes a crown 7 provided on a side surface of outer packaging case 2.

The watch 1 includes a movement 100 accommodated within the outer packaging case 2 as illustrated in FIG. 2. The movement 100 includes a main plate 110, a barrel and train wheel bridge 140, and a balance bridge 130. A barrel complete 81 accommodating a mainspring (not illustrated) is disposed between the main plate 110 and a barrel and train wheel bridge 140, and a center wheel and pinion 82 (not illustrated), a third wheel and pinion 83, a fourth wheel and pinion 84, and an escape wheelescape wheel 85 are also disposed between the main plate 110 and the barrel and train wheel bridge 140. A pallet fork 10, a balance 87, and the like are disposed between the main plate 110 and the balance bridge 130. The movement 100 drives the hour hand 4A, the minute hand 4B, and the seconds hand 4C, which are indicating needles.

The movement 100 is provided with, as a winding mechanism 90 winding up the mainspring, a setting stem 91, a clutch wheel 92, a winding pinion 93, a crown wheel 94, a first intermediate wheel 95, and a second intermediate wheel 96. Accordingly, rotation resulting from a rotating operation of the crown 7 can be transmitted to a ratchet wheel 18 to rotate an barrel arbor (not illustrated), winding up the mainspring. These components are the same as the corresponding components of a general mechanical movement, and descriptions of these components are omitted.

Pallet Fork

A configuration of the pallet fork 10 will now be described with reference to FIGS. 3 to 5.

Figure 3:
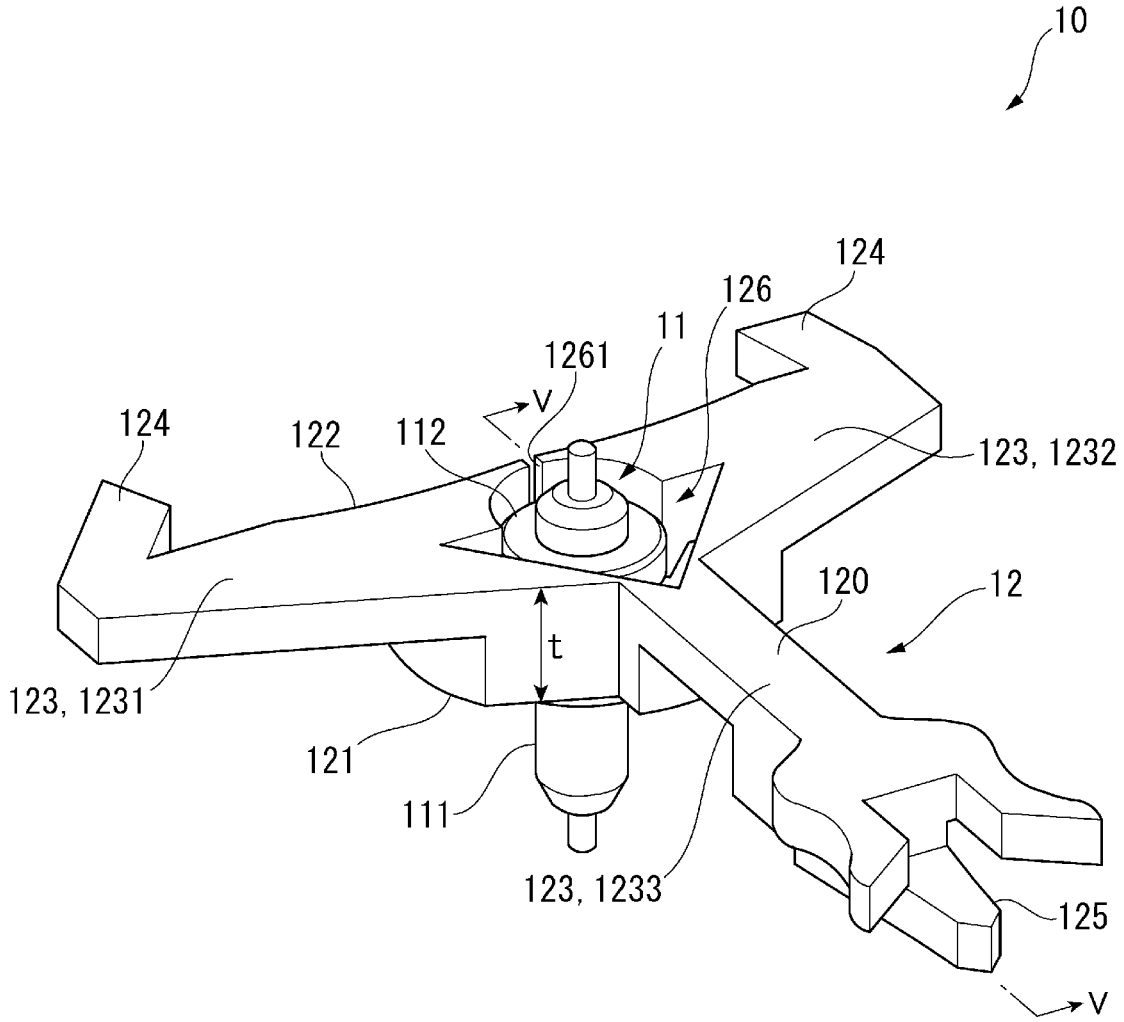
FIG. 3 is a perspective view schematically illustrating a pallet fork of First Embodiment.
Figure 4:
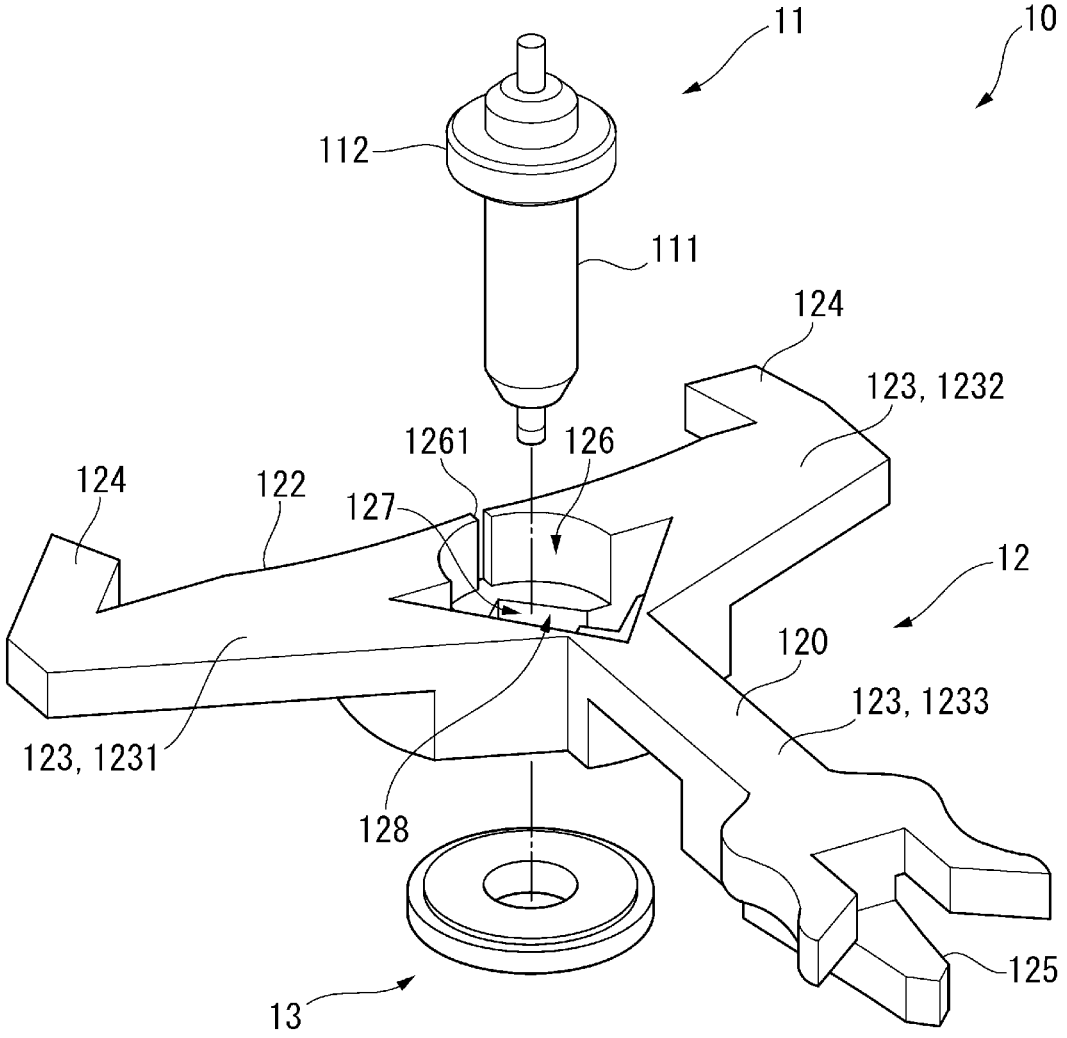
FIG. 4 is an exploded perspective view schematically illustrating the pallet fork of First Embodiment.
Figure 5:
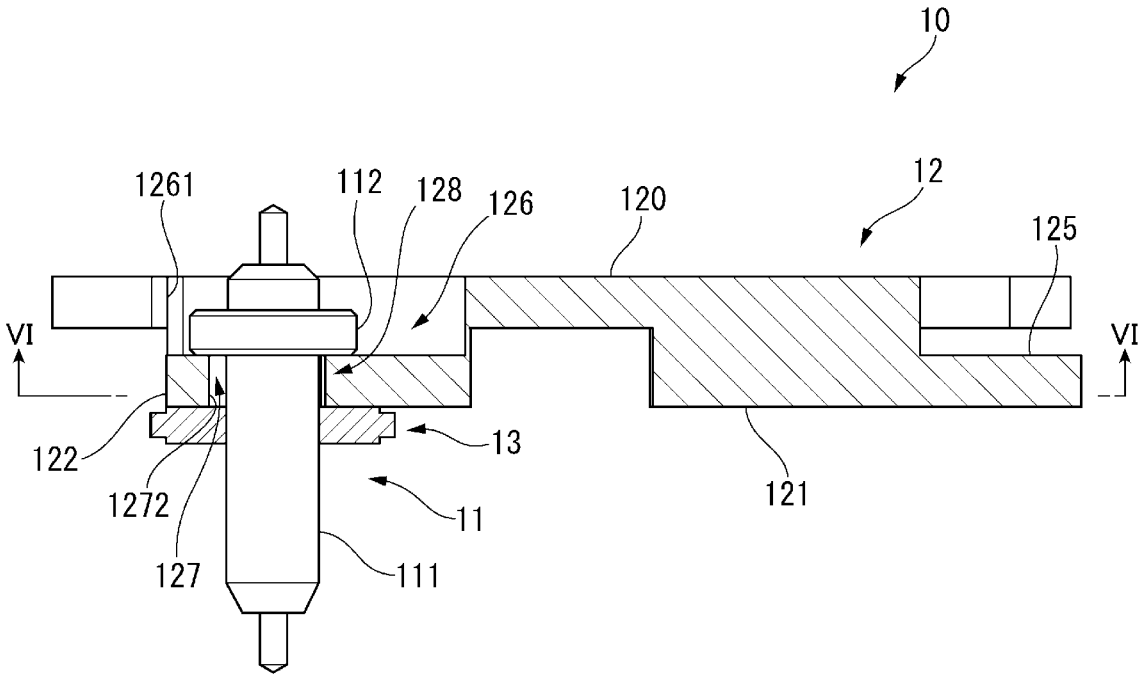
FIG. 5 is a cross-sectional view schematically illustrating the pallet fork of First Embodiment.
Figure 6:
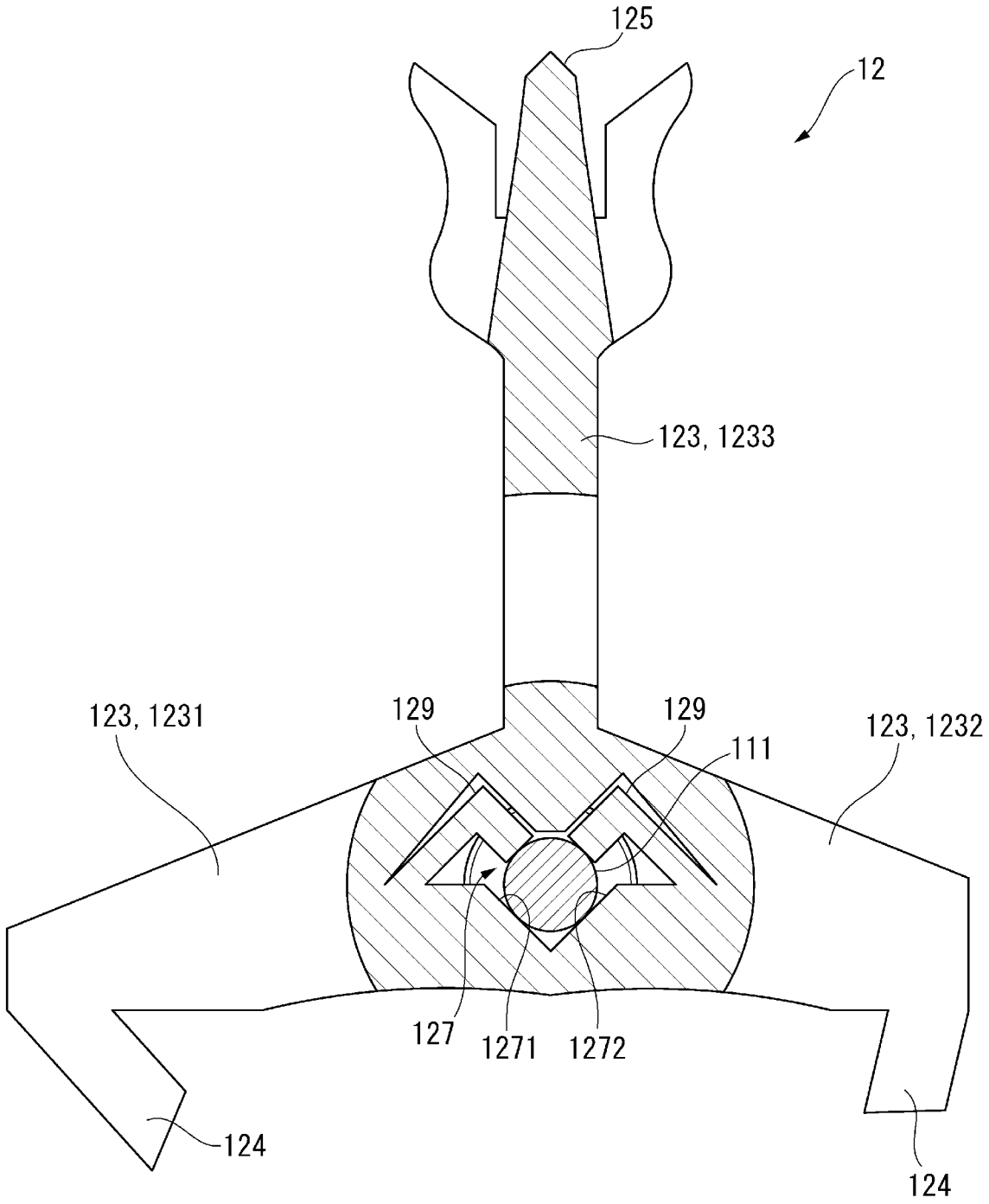
FIG. 6 is a cross-sectional view schematically illustrating the pallet fork of First Embodiment.

FIG. 3 is a perspective view schematically illustrating the pallet fork 10, FIG. 4 is an exploded perspective view schematically illustrating the pallet fork 10, FIG. 5 is a cross-sectional view taken along line V-V of FIG. 3, and FIG. 6 is a cross-sectional view taken along line VI-VI of FIG. 5.

As illustrated in FIGS. 3 to 6, the pallet fork 10 includes a pallet staff 11, a pallet body 12, and a fixing member 13. Note that the pallet fork 10 is an example of a watch component of the present disclosure.

Pallet Staff

The pallet staff 11 is a shaft member made of metal, and includes a shaft 111 and a flange portion 112 formed to protrude in a direction intersecting with an axial direction of the shaft 111, specifically, in a direction orthogonal to the axial direction. Tenon portions are formed on both ends of the shaft 111, and are rotatably supported by the main plate 110 illustrated in FIG. 2 and the pallet bridge (not illustrated).

Pallet Body

Figure 7:
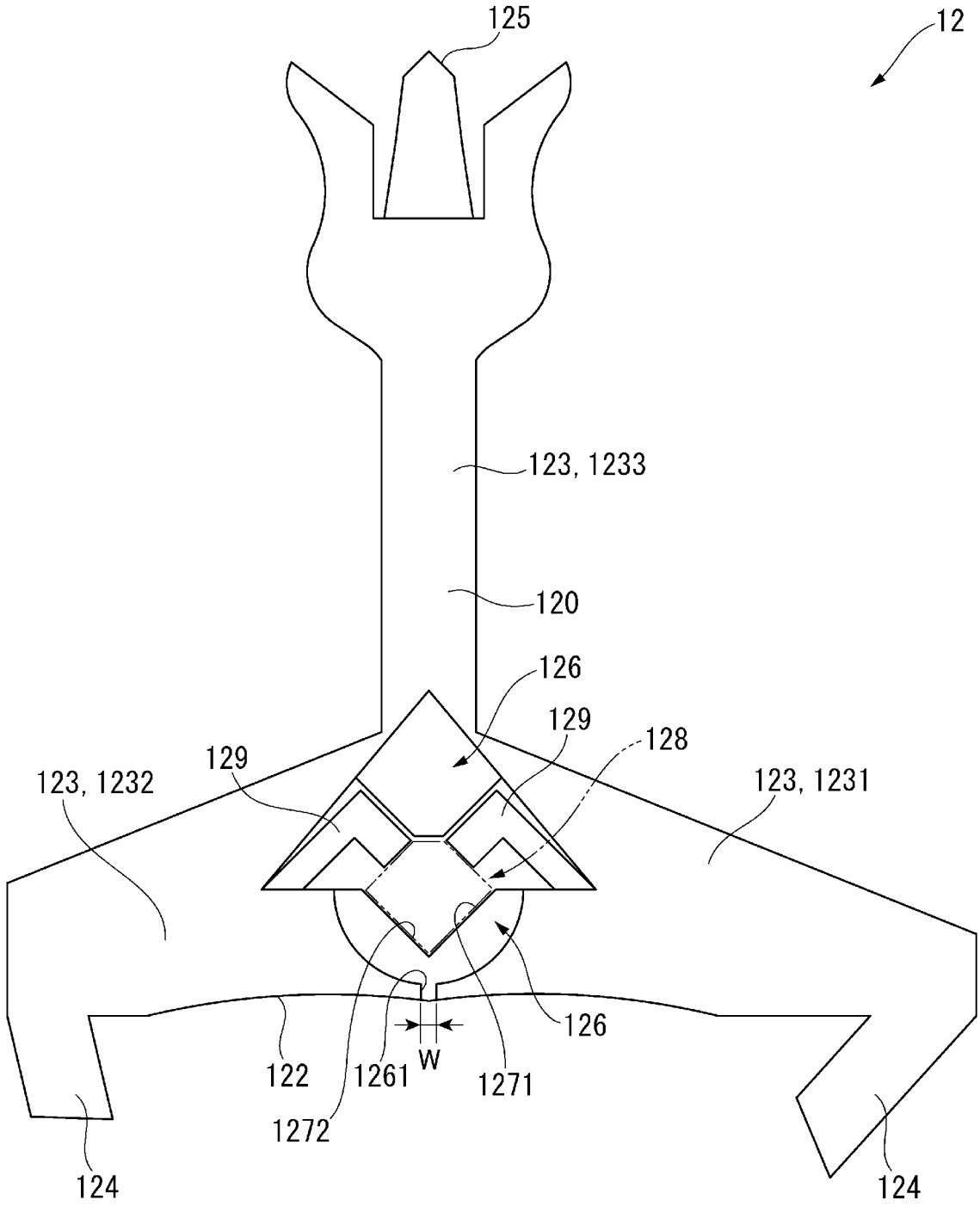
FIG. 7 is a front view schematically illustrating a pallet body of First Embodiment.
Figure 8:
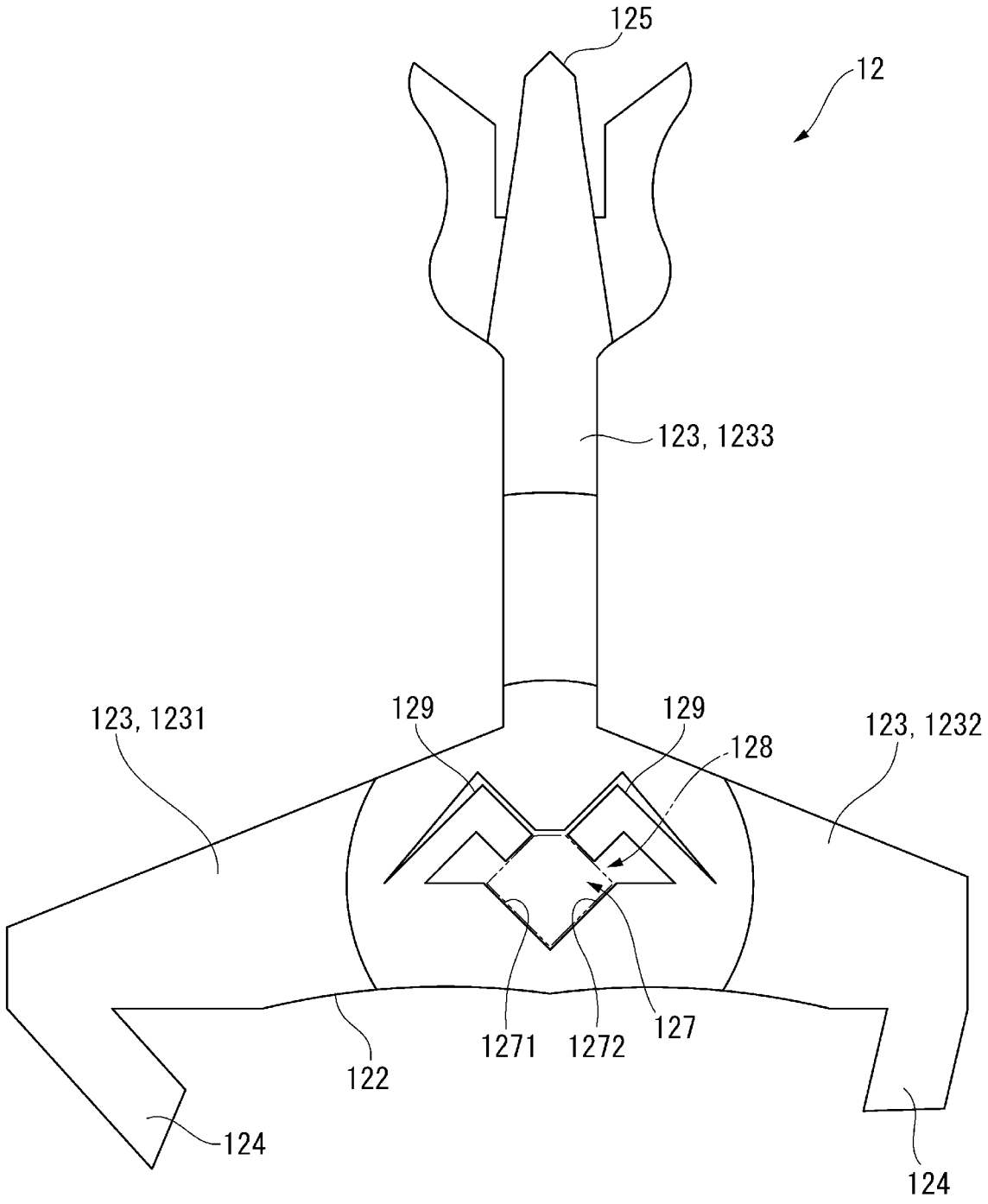
FIG. 8 is a rear view schematically illustrating the pallet body of First Embodiment.

FIG. 7 is a front view schematically illustrating the pallet body 12, and FIG. 8 is a rear view schematically illustrating the pallet body 12. Note that the pallet body 12 is an example of the body portion of the present disclosure.

As illustrated in FIGS. 3 to 8, the pallet body 12 is a component made of single crystal silicon and includes a first surface 120, a second surface 121, and a side surface 122 meeting the first surface 120 and the second surface 121. In the present embodiment, the pallet body 12 has a thickness dimension t of approximately 430 μm at a point with the maximum thickness.

The pallet body 12 is provided with three pallet beams 123: pallet arms 1231 and 1232, and a pallet rod 1233.

A pallet stone 124 is integrally formed at a tip of each of the pallet arms 1231 and 1232. A hook 125 is integrally formed at a tip of the pallet rod 1233.

The pallet body 12 is provided with a first recessed portion 126 opening into the first surface 120 and a second recessed portion 127 opening into the second surface 121. The first recessed portion 126 is shaped, in plan view, like a triangle to which a semicircle is coupled at a base of the triangle, and is formed at a position where the three pallet beams 123 meet.

The second recessed portion 127 is formed in a bottom surface portion of the first recessed portion 126. Thus, at a position where the first recessed portion 126 and the second recessed portion 127 overlap in plan view, an insertion hole 128 is formed to penetrate the first surface 120 side and the second surface 121 side of the pallet body 12. The insertion hole 128 is formed at the inner side of two holding portions 129 as described below and of two wall surfaces 1271 and 1272, of the wall surfaces constituting the second recessed portion 127, meeting at a prescribed angle. The insertion hole 128 is shaped such that the shaft 111 of the pallet staff 11 can be inserted through the insertion hole 128.

The second recessed portion 127 is provided with the two holding portions 129 protruding into the insertion hole 128. In the present embodiment, the two holding portions 129 extend, on a base end side, from the wall surfaces 1271 and 1272 of the second recessed portion 127 respectively, and are bent, on a tip side, forming into a substantial L shape. These two holding portions 129 are configured to abut the shaft 111 inserted through the insertion hole 128 and to be elastically deformable in the direction orthogonal to the axial direction of the shaft 111. Thus, the shaft 111 is pressed by the elastically deformed holding portions 129, and is interposed between the holding portions 129 and the two wall surfaces 1271 and 1272. Thus, the pallet body 12 is positioned relative to the shaft 111.

The first recessed portion 126 is provided with a communication groove 1261 communicating with the side surface 122. The communication groove 1261 is used as a passage through which air is evacuated from the first recessed portion 126 during a process of manufacturing the pallet body 12 as described below. Thus, the communication groove 1261 is suitably dimensioned to evacuate air, for example, a width W is approximately 50 μm. However, the width W of the communication groove 1261 is not limited to this, and any other dimension may be used so long as the air can be evacuated in a short period of time during the process of manufacturing the pallet body 12 as described below. For example, the width W may be 3 μm or greater.

Fixing Member

The fixing member 13 is a metal member formed like a circular ring. An inner diameter of the fixing member 13 is configured to be slightly smaller than an outer diameter of the shaft 111 of the pallet staff 11. The fixing member 13 is press-fitted over the shaft 111 opposite to the flange portion 112 across the pallet body 12. Thus, the pallet body 12 is interposed between the flange portion 112 and the fixing member 13, and thus fixed with respect to the axial direction of the shaft 111.

Furthermore, the pallet body 12 is interposed between the flange portion 112 and the fixing member 13 to suppress elastic deformation of the holding portions 129 described above. Thus, the pallet body 12 is also fixed with respect to the direction orthogonal to the axial direction of the shaft 111. With the pallet body 12 being fixed to the pallet staff 11, the flange portion 112 is accommodated in the first recessed portion 126 of the pallet body 12. That is, the first recessed portion 126 is an example of the accommodating recessed portion of the present disclosure. In the present embodiment, a depth dimension of the first recessed portion 126 is formed greater than a thickness dimension of the flange portion 112.

Thus, the flange portion 112 is wholly accommodated in the first recessed portion 126 with respect to the axial direction of the shaft 111.

When the pallet fork 10 configured as described above rotates around the pallet staff 11, either of the two pallet stones 124 comes into contact with a tip of a tooth portion of the escape wheelescape wheel 85 illustrated in FIG. 2. At this time, the pallet rod 1233 comes into contact with two backing pins (not illustrated) provided in the main plate 110, thus preventing the pallet fork 10 from further rotating in the same direction. As a result, rotation of the escape wheel 85 is also temporarily stopped.

Process of Manufacturing Pallet Body

A method of manufacturing the pallet body according to the present embodiment will be described based on the drawings.

FIGS. 9A to 9G are cross-sectional views illustrating the process of manufacturing the pallet fork.

Figure 9A:
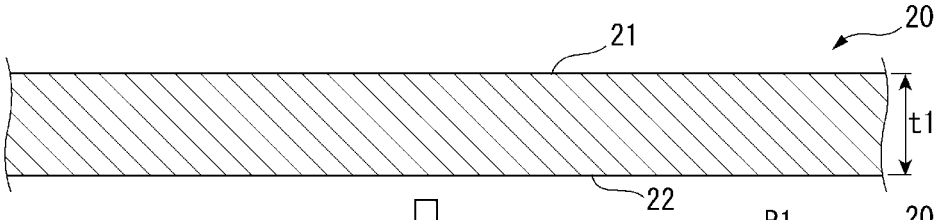
FIGS. 9A to 9G are schematic diagrams illustrating a process of manufacturing the pallet body according to First Embodiment.

In the present embodiment, a silicon substrate 20 having a thickness dimension t1 as illustrated in FIG. 9A is used as a base material, and the pallet fork 10 is manufactured by etching both a one surface portion 21 side of the silicon substrate 20 and a one surface portion 22 side of the silicon substrate 20 opposite to the one surface portion 21. In the present embodiment, for example, a silicon substrate 20 having a thickness dimension t1 of approximately 430 μm is used as a base material to manufacture the pallet fork 10. Note that the thickness dimension t1 of the silicon substrate 20 is not limited to this, and can be arbitrarily selected according to the specification of the watch component to be manufactured.

Figure 9B:
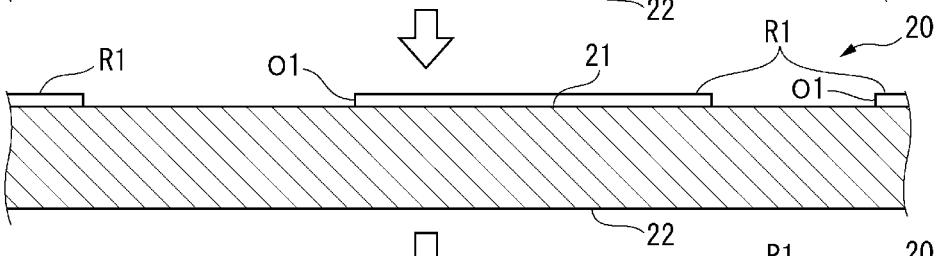

Specifically, first, a first resist pattern R1 is formed on the one surface portion 21 of the silicon substrate 20 illustrated in FIG. 9A by using, for example, a photolithography method (first resist pattern forming step). FIG. 9B is a diagram illustrating a state in which the first resist pattern R1 is formed on the one surface portion 21 of the silicon substrate 20. The first resist pattern R1 includes openings O1. Note that, during a first etching step described below, positions corresponding to the openings O1 of the one surface portion 21 are etched.

Figure 9C:
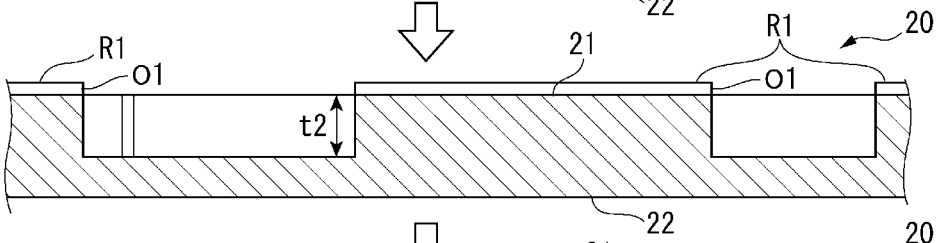

Then, as illustrated in FIG. 9C, the silicon substrate 20 is etched using the first resist pattern R1 as a mask. For etching, for example, Deep Reactive Ion Etching (DRIE) based on Inductively Coupled Plasma (ICP) can be used.

Figure 10:
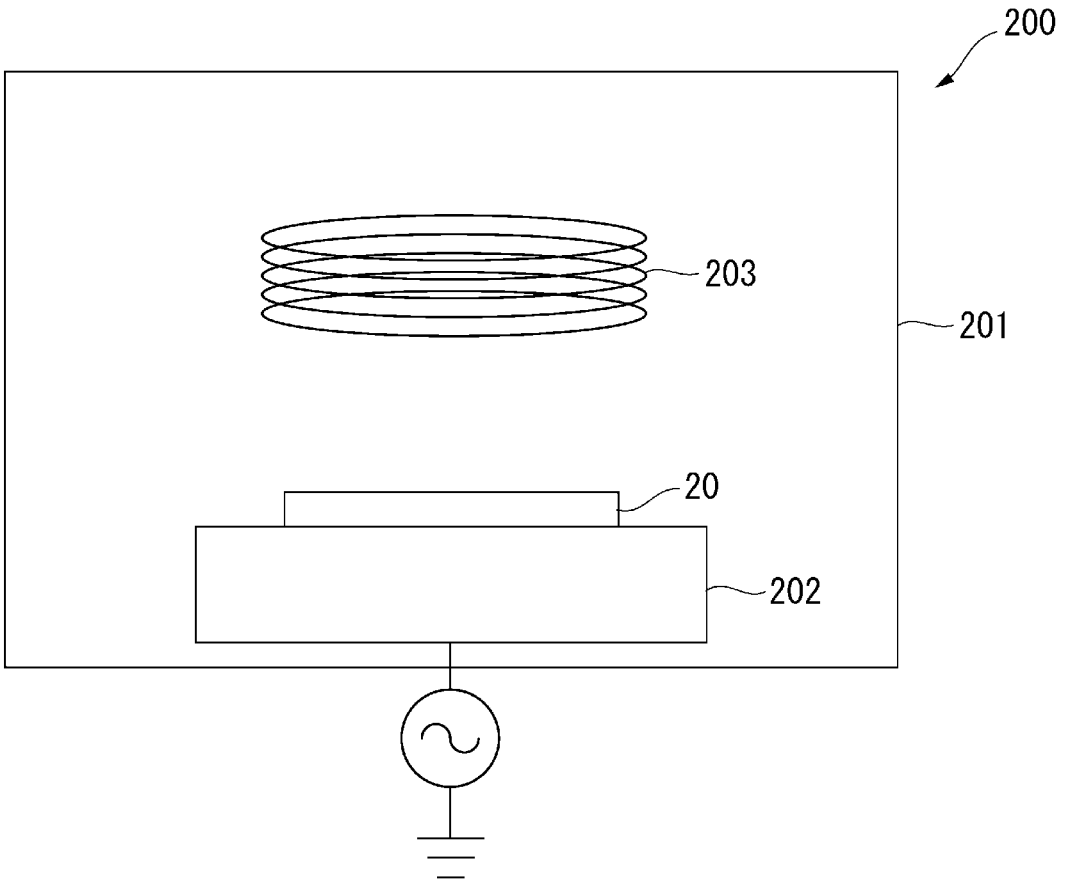
FIG. 10 is a schematic diagram illustrating an etching device for manufacturing the pallet body according to First Embodiment.

FIG. 10 is a schematic diagram illustrating an etching device 200.

The etching device 200 illustrated in FIG. 10 includes a vacuum chamber 201, a stage 202, and a coil 203.

The vacuum chamber 201 is a reaction chamber in which etching is performed, and accommodates the stage 202 and the coil 203 inside the vacuum chamber 201.

The silicon substrate 20 illustrated in FIG. 9B is set on the stage 202 of the etching device 200 described above. At this time, the silicon substrate 20 is set such that the other surface portion 22 side of the silicon substrate 20 faces an upper surface of the stage 202. Then, the pressure in the vacuum chamber 201 is reduced to a predetermined vacuum pressure, for example, approximately 1 to 30 Pa.

Subsequently, an etching gas, for example, $SF_6$, is introduced into the vacuum chamber 201, and a high-frequency large current is passed through the coil 203 to generate a plasma with the etching gas. The stage 202 is biased to draw plasma particles with the etching gas through the openings O1 of the first resist pattern R1 to the one surface portion 21 of the silicon substrate 20. Thus, the silicon substrate 20 is etched substantially vertically from the one surface portion 21 side in a thickness direction along the first resist pattern R1, forming recessed portions.

Then, a deposition gas, for example, $C_4F_8$, is introduced into the vacuum chamber 201, and a high-frequency large current is passed through the coil 203 to generate a plasma with the deposition gas. The stage 202 is biased to draw plasma particles with the deposition gas through the openings O1 of the first resist pattern R1 to the one surface portion 21 of the silicon substrate 20. Thus, a protective film is formed on side walls of the recessed portions formed by the etching. In other words, the side walls of the recessed portions are deposited.

A cycle etching process referred to as a so-called Bosch process is performed in which the etching and deposition as described above are repeated. Thus, recessed portions with a depth t2 are formed in the one surface portion 21 of the silicon substrate 20 (first etching step). In the present embodiment, recessed portions with a depth t2 of approximately 260 μm are formed, for example. Note that the depth of the recessed portions formed during the first etching step is not limited to this, and can be arbitrarily changed according to the shape of the watch component to be manufactured.

In this case, the other surface portion 22 side of the silicon substrate 20, that is, the surface side of the silicon substrate 20 set on the stage 202, is cooled by a cooling gas such as helium gas. Accordingly, during the first etching step, the silicon substrate 20 is maintained at approximately 10° C. Thus, an increase in temperature of the silicon substrate 20 can be suppressed, thus allowing suppression of excessive reaction between the plasma with the etching gas and the silicon substrate 20 caused by an increase in temperature. Accordingly, etching verticality can be prevented from being impaired, and machining accuracy of etching on the one surface portion 21 side can be increased.

Figure 9D:
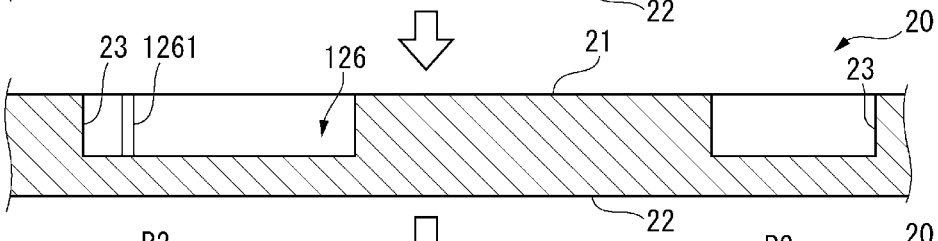

Then, the silicon substrate 20 is taken out from the vacuum chamber 201, and the first resist pattern R1 is removed to be a form illustrated in FIG. 9D. The first resist pattern R1 can be removed by wet etching using fuming nitric acid, an organic solvent, or the like, or by oxygen plasma ashing or the like.

Figure 11:
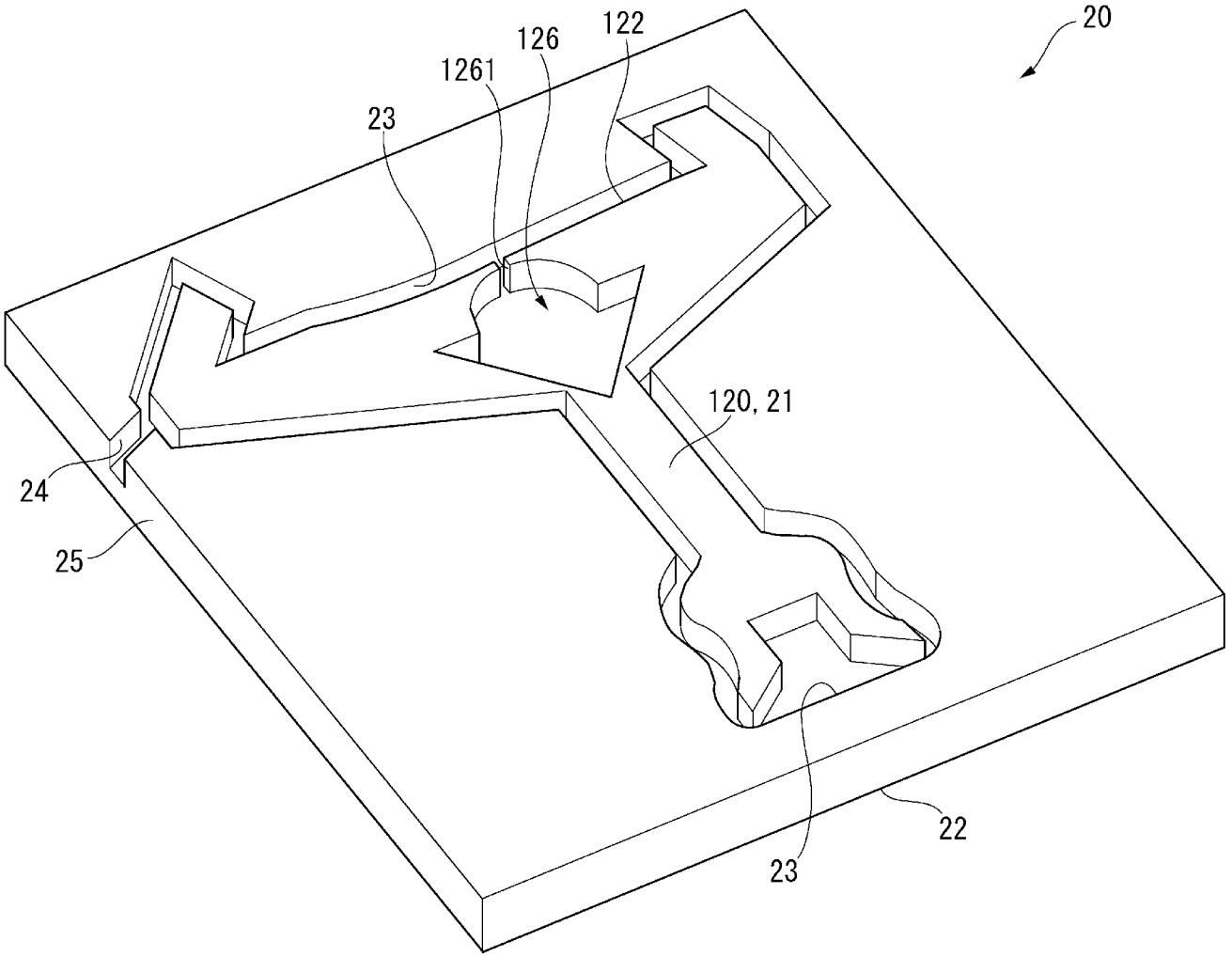
FIG. 11 is a schematic diagram illustrating the pallet body of First Embodiment during manufacture.

FIG. 11 is a perspective view of the silicon substrate 20 in the state of FIG. 9D.

As illustrated in FIG. 11, in the silicon substrate 20 at this stage, the first surface 120 side of the pallet body 12 has been formed. That is, the one surface portion 21 of the silicon substrate 20 constitutes the first surface 120 of the pallet body 12. As described above, the first surface 120 side of the pallet body 12 is provided with the first recessed portion 126 and the communication groove 1261, through which the first recessed portion 126 communicates with the side surface 122 of the pallet body 12.

Furthermore, an outer peripheral recessed portion 23 is formed from which the side surface 122 of the pallet body 12 is cut out, and the outer peripheral recessed portion 23 communicates with a side surface portion 25 of the silicon substrate 20 through the groove portion 24.

Figure 9E:
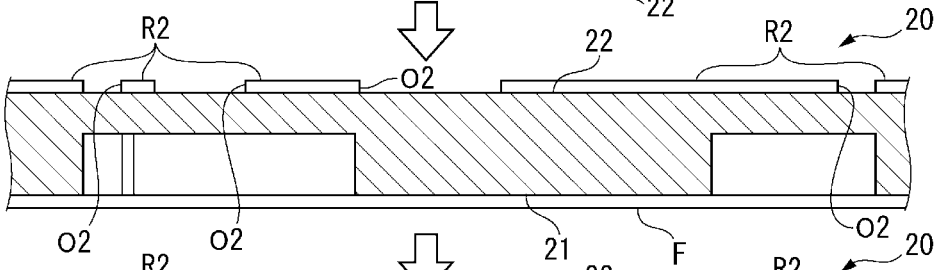

Then, as illustrated in FIG. 9E, a dry film F is applied to the one surface portion 21 of the silicon substrate 20 (dry film applying step). In the present embodiment, as the dry film F, a support such as a polyester film is used to which a photoresist is uniformly applied. Thus, the dry film F can be prevented from being damaged, during a second etching step described below, by the plasma into which the etching gas has been transformed.

The silicon substrate 20 is inverted, and a second resist pattern R2 is formed on the other surface portion 22 of the silicon substrate 20 by using, for example, the photolithography method (second resist pattern forming step). The second resist pattern R2 includes openings O2. During the second etching step described below, positions corresponding to the openings O2 of the other surface portion 22 are etched.

Note that FIG. 9E illustrates a state in which the silicon substrate 20 is turned upside down such that the other surface portion 22 side corresponds to an upper side.

Then, the silicon substrate 20 in the state of FIG. 9E is set again on stage 202 in the vacuum chamber 201. At this time, in contrast to the above-described process, the silicon substrate 20 is set such that the one surface portion 21 side faces the upper surface of the stage 202. Then, as described above, the pressure in the vacuum chamber 201 is reduced to a predetermined vacuum pressure. At this time, the air in the first recessed portion 126 is evacuated from the side surface portion 25 of the silicon substrate 20 via the communication groove 1261, the outer peripheral recessed portion 23, and the groove portion 24 illustrated in FIG. 11.

Figure 9F:
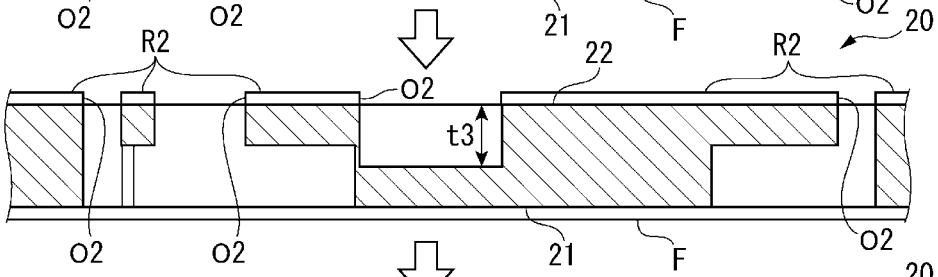

Subsequently, the silicon substrate 20 in the state of FIG. 9E is etched by the Bosch process (second etching step). Accordingly, as illustrated in FIG. 9F, the silicon substrate 20 is etched substantially vertically from the other surface portion 22 side in the thickness direction along the second resist pattern R2, forming recessed portions with a depth of t3. In the present embodiment, recessed portions with a depth t3 of approximately 260 μm, for example, are formed. Note that, similar to the first etching step, the depth of the recessed portion formed during the second etching step is not limited to this, and can be arbitrarily changed in accordance with the shape of the watch component to be manufactured.

A through-hole is formed in a portion where the etched position of the one surface portion 21 side overlaps with the etched position of the other surface portion 22 side such that the through-hole penetrates the silicon substrate 20 from the one surface portion 21 side to the other surface portion 22 side. In other words, an insertion hole 128 illustrated in FIG. 7 is formed.

At this time, similar to the first etching step, the one surface portion 21 side is cooled by the cooling gas, but the dry film F applied to the one surface portion 21 side prevents the cooling gas from escaping from the one surface portion 21 side to the other surface portion 22 side via the insertion hole 128. Consequently, also during the second etching step, the silicon substrate 20 can be efficiently cooled, thus allowing suppression of excessive reaction between the plasma by the etching gas and the silicon substrate 20 caused by the increase in temperature. Accordingly, etching verticality can be prevented from being impaired, and machining accuracy of etching on the other surface portion 22 side can be increased.

Figure 9G:
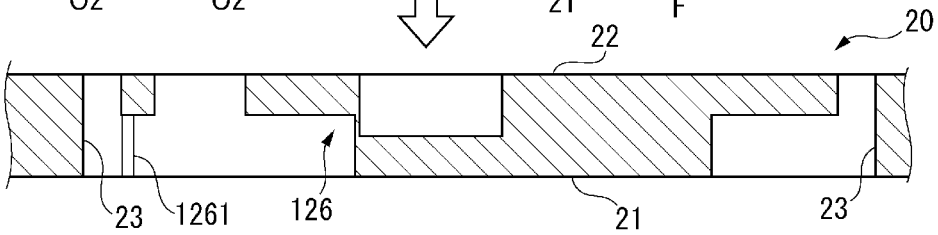

Then, the silicon substrate 20 is taken out from the vacuum chamber, and the second resist pattern R2 and the dry film F are removed to be a form as illustrated in FIG. 9G.

Finally, the portion constituting the pallet body 12 is removed from the silicon substrate 20. The pallet body 12 is thus manufactured.

Advantageous Effects of First Embodiment

According to the present embodiment, the following advantageous effects can be produced.

In the present embodiment, the pallet fork 10 can be easily assembled because the pallet body 12 can be fixed to the pallet staff 11 by being interposed between the flange portion 112 and the fixing member 13. At this time, since the flange portion 112 is accommodated in the first recessed portion 126 of the pallet body 12, the flange portion 112 is prevented from protruding in the axial direction of the shaft 111 with respect to the pallet body 12. In other words, the pallet fork 10 can be thinned. Thus, interference with other watch components can be prevented, and the degree of freedom of design can be increased in terms of arrangement of the pallet fork 10 and the like.

A distance between the flange portion 112 and the fixing member 13 in an axial direction of the shaft 111 can be shortened. Thus, the degree of freedom can be increased in terms of design of the position of the flange portion 112 with respect to the shaft 111. In other words, the flange portion 112 can be disposed at one end side or the other end side of the shaft 111. This enables an increase in the range over which the position of the pallet body 12 can be adjusted with respect to the axial direction of the shaft 111.

Furthermore, the pallet body 12 is fixed to the pallet staff 11 by being interposed between the flange portion 112 and the fixing member 13. This eliminates a need to fix the pallet body 12 to the pallet staff 11 by, for example, press-fitting the shaft 111 of the pallet staff 11 into the pallet body 12. Thus, the pallet body 12 can be prevented from being cracked or chipped when the pallet staff 11 is press-fitted into the pallet body 12.

In the present embodiment, the pallet body 12 protrudes into the insertion hole 128, and includes the two holding portions 129 that are elastically deformable in the direction intersecting with the axial direction of the shaft 111. The pallet body 12 and the pallet staff 11 are positioned by interposing the shaft 111 between the two holding portions 129 and the two meeting wall surfaces 1271 and 1272. Thus, the pallet body 12 is positioned relative to the pallet staff 11 by simply inserting the shaft 111 through the insertion hole 128. This allows assembly of the pallet fork 10 to be facilitated.

In the present embodiment, the communication groove 1261 is formed through which the first recessed portion 126 communicates with the side surface 122. This enables both sides of the silicon substrate 20 to be etched while being cooled by the cooling gas. Thus, both sides of the single silicon substrate 20 can be etched with high machining accuracy.

Here, when it is assumed that the communication groove 1261 is not formed in the first recessed portion 126, applying the dry film F to the one surface portion 21 forms the first recessed portion 126 into a sealed space. Thus, even when the pressure in the vacuum chamber 201 is reduced to the vacuum pressure, the inside of the first recessed portion 126 is maintained at atmospheric pressure. This leads to a difference in atmospheric pressure between the inside and outside of the first recessed portion 126, and thus, the dry film F may be damaged.

On the other hand, in the present embodiment, the air in the first recessed portion 126 is evacuated via the communication groove 1261, the outer peripheral recessed portion 23, and the groove portion 24, as described above. That is, the inside of the first recessed portion 126 is at vacuum pressure, and thus, no difference occurs in atmospheric pressure between the inside and outside of the first recessed portion 126. Thus, the dry film F can be prevented from being damaged due to a difference in atmospheric pressure.

Second Embodiment

Now, Second Embodiment of the present disclosure will be described below with reference to the drawings. A pallet fork 10A of Second Embodiment differs from the pallet fork of First Embodiment in that the communication groove 1261 is not formed. Note that components of Second Embodiment that are identical or similar to the corresponding components of First Embodiment are denoted by identical reference signs and that descriptions of these components are omitted.

Pallet Fork

Figure 12:
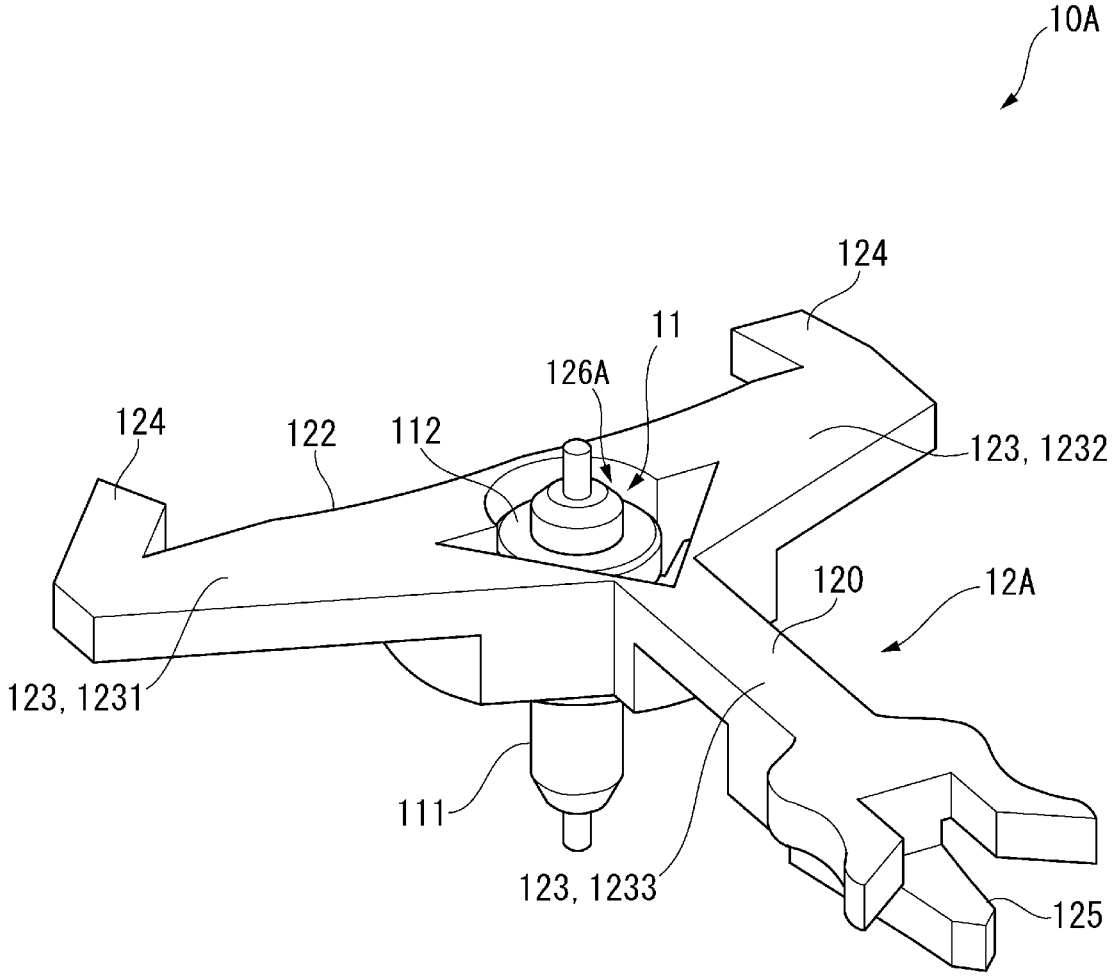
FIG. 12 is a perspective view schematically illustrating a pallet fork of Second Embodiment of the present disclosure.
Figure 13:
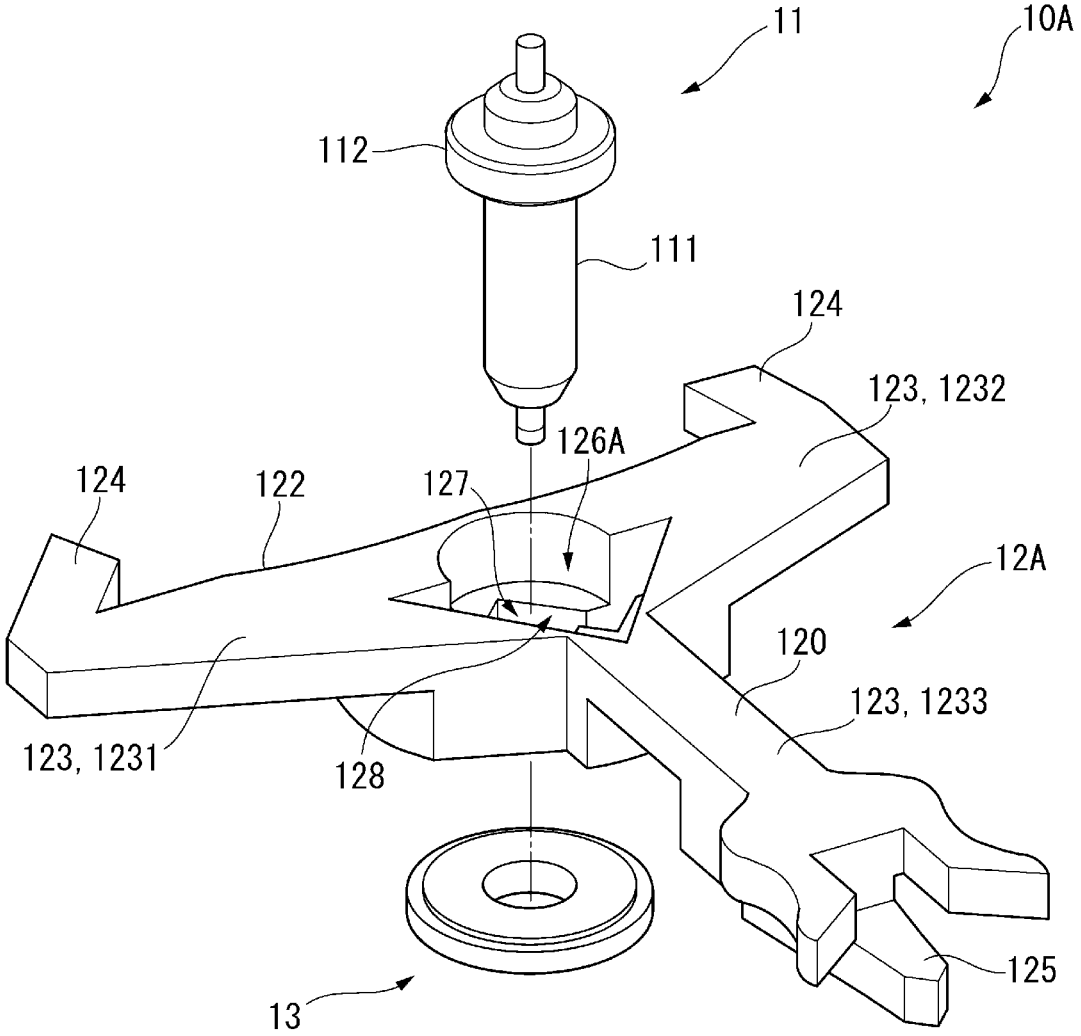
FIG. 13 is an exploded perspective view schematically illustrating the pallet fork of Second Embodiment.

FIG. 12 is a perspective view schematically illustrating the pallet fork 10A, and FIG. 13 is an exploded perspective view schematically illustrating the pallet fork 10A.

As illustrated in FIGS. 12 and 13, the pallet fork 10A includes the pallet staff 11, a pallet body 12A, and the fixing member 13.

The pallet body 12A is provided with a first recessed portion 126A on the first surface 120 side. However, unlike First Embodiment described above, the first recessed portion 126A is not provided with a communication groove communicating with the side surface 122.

Process of Manufacturing Pallet Body

Now, a method of manufacturing a pallet body according to the present embodiment will be described based on the drawings.

FIGS. 14A to 14G are cross-sectional views illustrating a process of manufacturing a pallet fork.

Figure 14A:
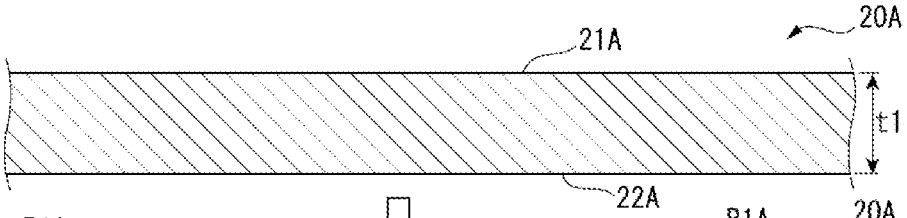
FIGS. 14A to 14G are schematic diagrams illustrating a process of manufacturing the pallet body according to Second Embodiment.

In the present embodiment, similar to First Embodiment, a silicon substrate 20A having a thickness dimension t1 as illustrated in FIG. 14A is used as a base material. The pallet fork 10A is manufactured by etching both a one surface portion 21A side of the silicon substrate 20A and a other surface portion 22A side of the silicon substrate 20A opposite to the one surface portion 21A.

Figure 14B:
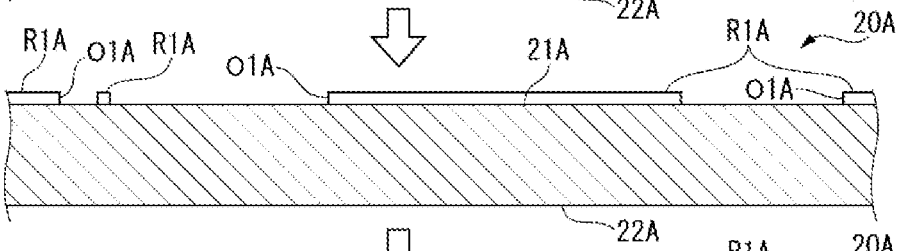

Specifically, first, a first resist pattern R1A is formed on the one surface portion 21A of the silicon substrate 20A illustrated in FIG. 14A by using, for example, the photolithography method (first resist pattern forming step). FIG. 14B is a diagram illustrating a state in which the first resist pattern R1A is formed on the one surface portion 21A of the silicon substrate 20A. The first resist pattern R1A includes openings O1A. Here, in the present embodiment, the first resist pattern R1A is formed at a position corresponding to a communication groove. In other words, during a first etching step described below, no communication groove is formed.

Figure 14C:
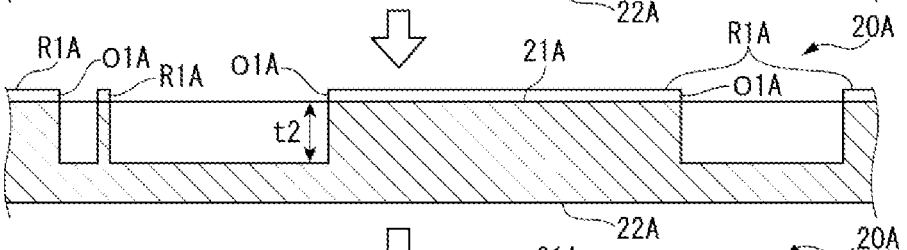

Then, as illustrated in FIG. 14C, etching based on the Bosch process is performed on the silicon substrate 20A by using the first resist pattern R1A as a mask, similar with First Embodiment (first etching step). Accordingly, the silicon substrate 20A is etched substantially vertically from the one surface portion 21A side in the thickness direction along the first resist pattern R1A, forming recessed portions with a depth of t2.

Similar to First Embodiment, the other surface portion 22A side of the silicon substrate 20A, that is, the surface side of the silicon substrate 20A set on the stage 202, is cooled by a cooling gas such as helium gas.

Figure 14D:
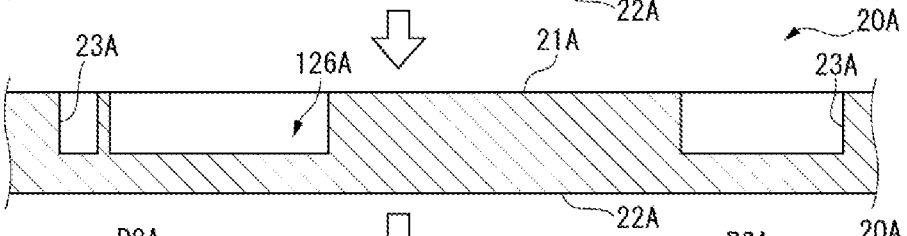

Then, the first resist pattern R1A is removed to be a form illustrated in FIG. 14D.

Figure 15:
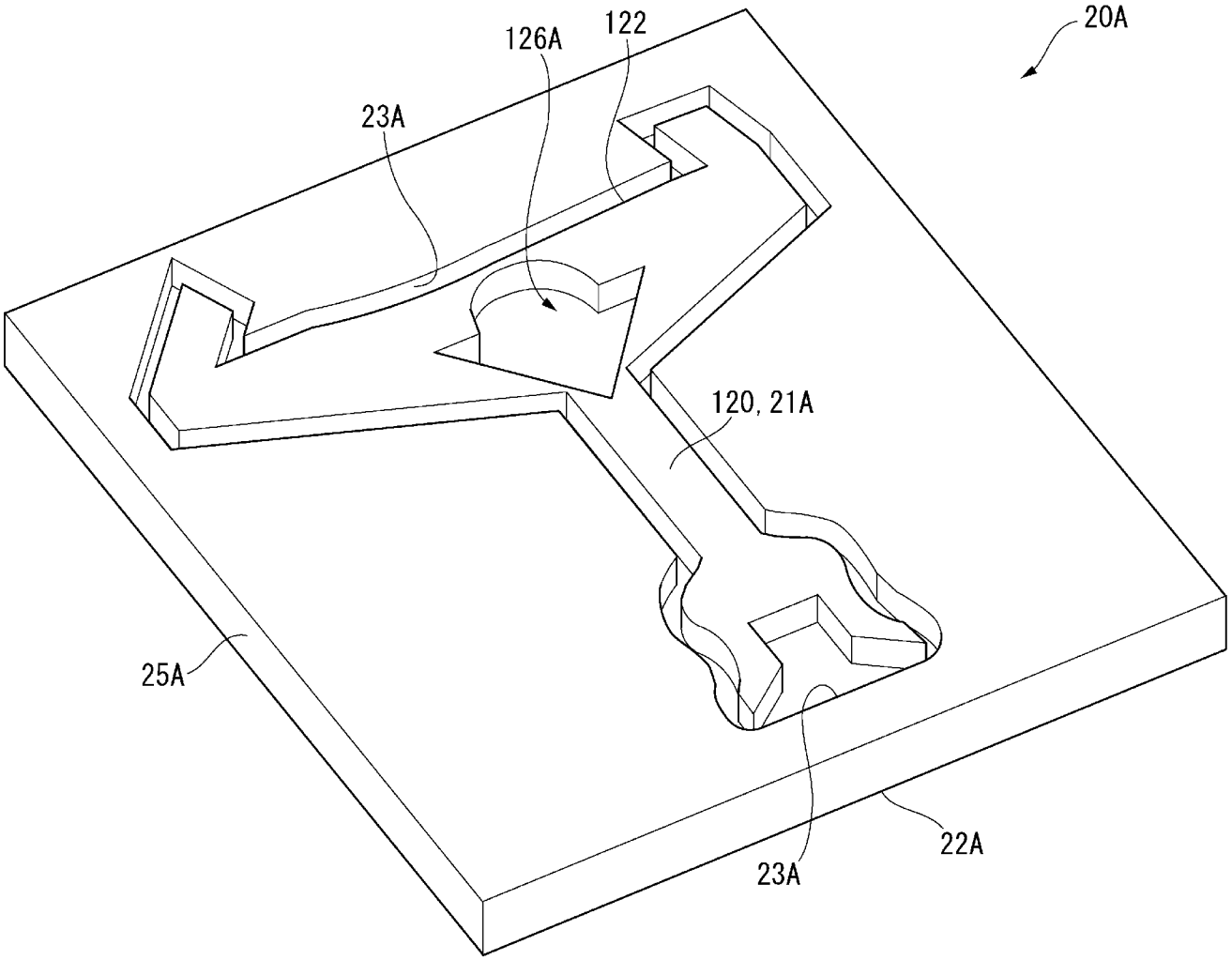
FIG. 15 is a schematic diagram illustrating the pallet body of Second Embodiment during manufacture.

FIG. 15 is a perspective view of the silicon substrate 20A in the state of FIG. 14D.

As illustrated in FIG. 15, in the present embodiment, no communication groove is formed, thus preventing the first recessed portion 126A from communicating with an outer peripheral recessed portion 23A. In the present embodiment, no groove that allows a side surface portion 25A of the silicon substrate 20A to communicate with the outer peripheral recessed portion 23A, is formed.

Figure 14E:
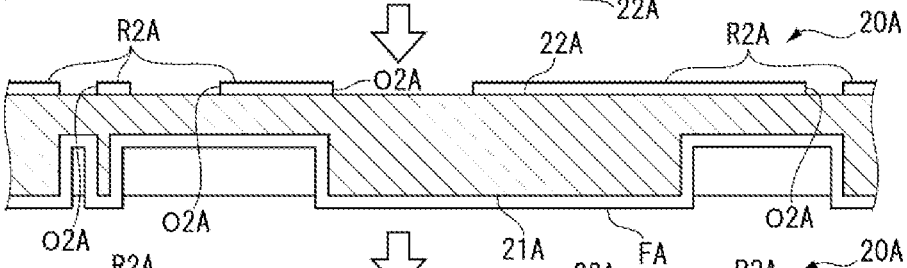

Then, as illustrated in FIG. 14E, a film FA is formed on the one surface portion 21A of the silicon substrate 20A. In the present embodiment, the film FA is formed along the one surface portion 21A, and further along bottom surfaces and wall surfaces of the recessed portions formed during the first etching step. Thus, no sealed space is formed by the film FA and the recessed portions.

Note that in the present embodiment, a TetraEthyl Ortho-Silicate (TEOS, tetraethoxysilane) film or a metal film can be used as the film FA.

A second resist pattern R2A is formed on the other surface portion 22A of the silicon substrate 20A by using, for example, the photolithography method (second resist pattern forming step). The second resist pattern R2A includes openings O2A.

Then, the silicon substrate 20A in the state of FIG. 14E is set again on the stage 202 in vacuum chamber 201. At this time, in contrast to the above description, the silicon substrate 20A is set such that the one surface portion 21A side faces the upper surface of the stage 202. Then, as described above, the pressure in the vacuum chamber 201 is reduced to a predetermined vacuum pressure. At this time, the lack of a sealed space in the first recessed portion 126A prevents occurrence of a difference in atmospheric pressure. Thus, in the present embodiment, the film FA is prevented from being damaged due to a difference in atmospheric pressure.

Figure 14F:
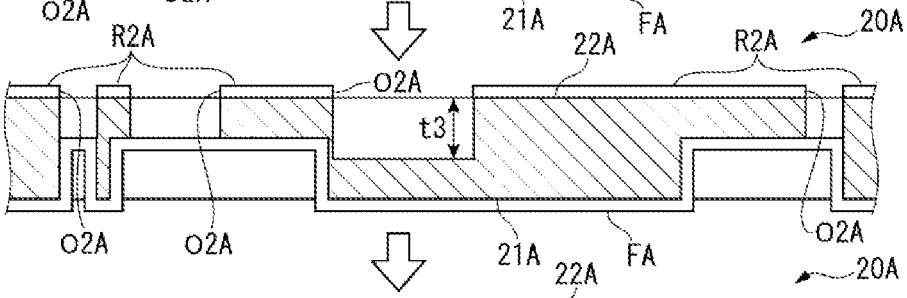

Subsequently, as described above, the silicon substrate 20A is etched by the Bosch process (second etching step). Accordingly, as illustrated in FIG. 14F, the silicon substrate 20A is etched substantially vertically from the other surface portion 22A side in the thickness direction along the second resist pattern R2A, forming recessed portions with a depth of t3.

At this time, a through-hole is formed in a portion where the etched position of the one surface portion 21A side overlaps with the etched position of the other surface portion 22A side such that the through-hole penetrates the silicon substrate 20A from the one surface portion 21A side to the other surface portion 22A side.

Here, the one surface portion 21A side is cooled by the cooling gas. However, the film FA formed on the one surface portion 21A side prevents the cooling gas from escaping from the one surface portion 21A side to the other surface portion 22A side via the through-hole.

Figure 14G:
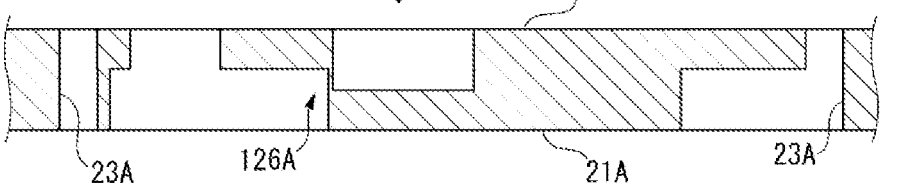

The silicon substrate 20A is taken out from the vacuum chamber 201, and the second resist pattern R2A and the film FA are removed as illustrated in FIG. 14G.

Finally, the portion of the silicon substrate 20A constituting the pallet body 12A is removed from the silicon substrate 20A. The pallet body 12A is thus manufactured.

Advantageous Effects of Second Embodiment

According to the present embodiment, the following advantageous effects can be produced.

In the present embodiment, in the pallet body 12A, the first recessed portion 126A and the side surface 122 do not communicate with each other. Thus, the pallet body 12A can be provided with an increased component strength.

In the present embodiment, the film FA is formed along the one surface portion 21A and further along the bottom surfaces and wall surfaces of the recessed portions formed during the first etching step. This allows both sides of the silicon substrate 20A to be etched while being cooled by the cooling gas. Thus, both sides of the single silicon substrate 20A can be etched with high machining accuracy.

Third Embodiment

Now, Third Embodiment of the present disclosure will be described below with reference to the drawings. A pallet fork 10B of Third Embodiment differs from the pallet forks of First Embodiment and Second Embodiment in that a fixing member 13B is accommodated in the first recessed portion 126. Note that components of Third Embodiment that are identical or similar to the corresponding components of First Embodiment are denoted by identical reference signs and that descriptions of these components are omitted.

Pallet Fork

Figure 16:
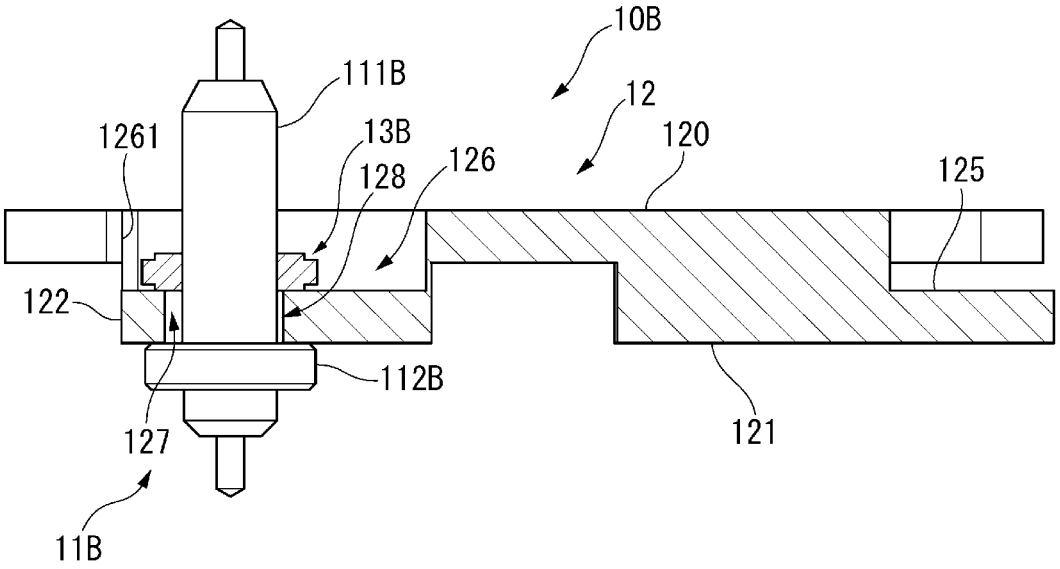
FIG. 16 is a cross-sectional view schematically illustrating a pallet fork of Third Embodiment.

FIG. 16 is a cross-sectional view schematically illustrating the pallet fork 10B.

As illustrated in FIG. 16, the pallet fork 10B includes a pallet staff 11B, the pallet body 12, and a fixing member 13B.

In the present embodiment, unlike First Embodiment and Second Embodiment, the fixing member 13B is accommodated in the first recessed portion 126. Here, a depth dimension of the first recessed portion 126 is formed greater than a thickness dimension of the fixing member 13B. Thus, the fixing member 13B is wholly accommodated in the first recessed portion 126 with respect to the axial direction of the shaft 111.

A flange portion 112B of the pallet staff 11B is disposed on the second surface 121 side of the pallet body 12. Accordingly, the pallet body 12 is interposed between the flange portion 112B and the fixing member 13B, and thus fixed with respect to the axial direction of the shaft 111B.

Note that, in the present embodiment, the flange portion 112B can be accommodated in the first recessed portion 126 and that the fixing member 13B can be disposed on the second surface 121 side. In other words, in FIG. 16, the flange portion 112B can also be accommodated in the first recessed portion 126 by turning the pallet staff 11B upside down such that the flange portion 112B is disposed on the upper side. In this case, the flange portion 112B is disposed on the upper side of FIG. 16, and thus the position of the pallet body 12 is also moved to the upper side of FIG. 16 with respect to the pallet staff 11B.

Advantageous Effects of Third Embodiment

According to the present embodiment, the following advantageous effects can be produced.

In the present embodiment, the fixing member 13B is accommodated in the first recess 126 of the pallet body 12. This prevents the fixing member 13B from protruding in the axial direction of the shaft 111 with respect to the pallet body 12. In other words, the pallet fork 10B can be thinned. Thus, interference with other watch components can be prevented, and the degree of freedom of design can be increased in terms of arrangement of the pallet fork 10B and the like.

In the present embodiment, the flange portion 112 can also be accommodated in the first recessed portion 126 by turning the pallet staff 11B upside down. In this case, the position of the pallet body 12 is changed relative to the pallet staff 11B. In other words, the position of the pallet body 12 can be adjusted in two stages by turning the pallet staff 11B upside down without the need to provide a plurality of types of pallet staffs with different flange portion positions.

Other Embodiments

Note that the present disclosure is not limited to the embodiments described above and that the present disclosure includes variations, improvements, and the like within the scope in which the object of the present disclosure can be accomplished.

In the embodiments described above, two elastically deformable holding portions 129 are formed that protrude into the insertion hole 128. However, the embodiments are not limited to this.

Figure 17:
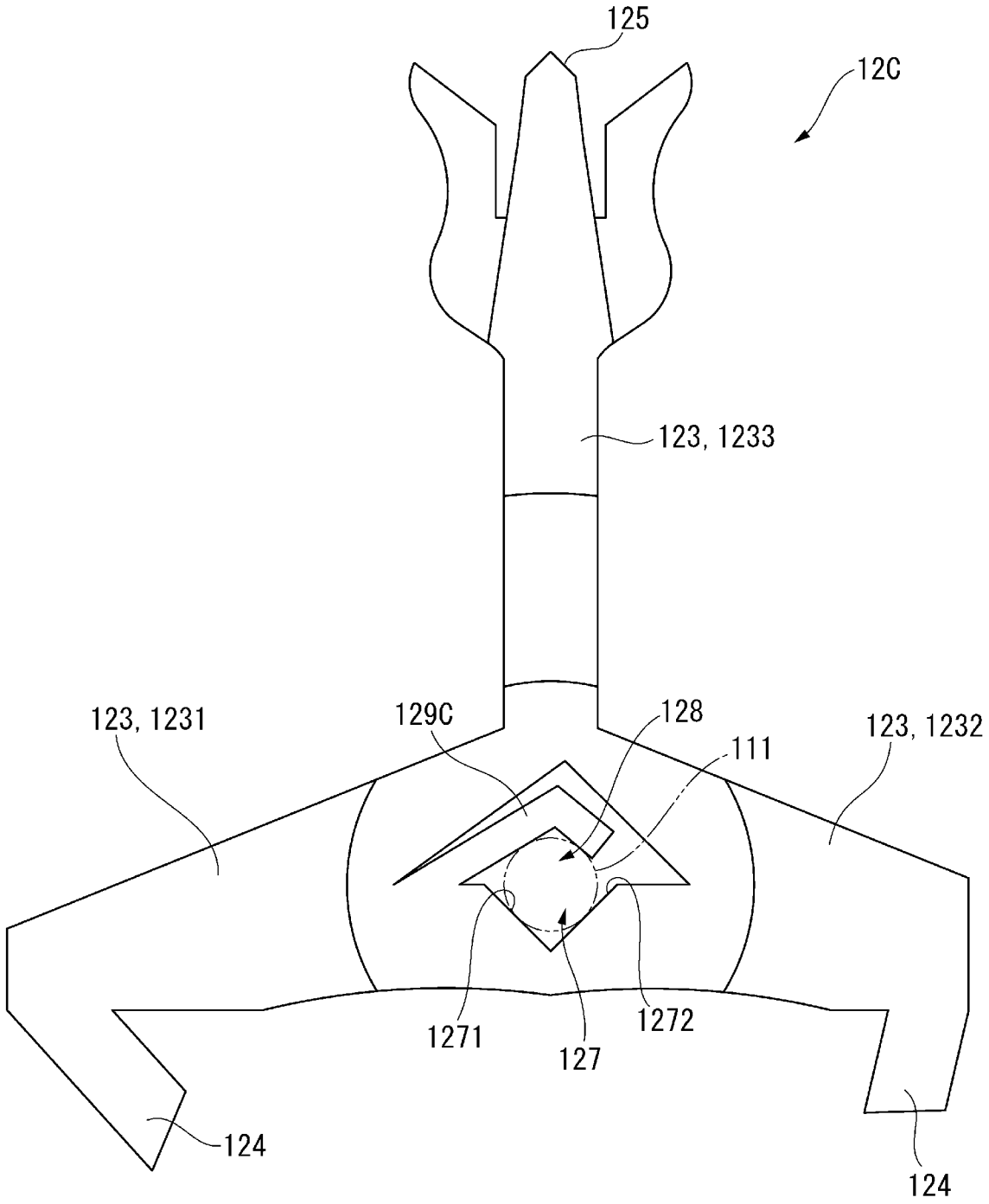
FIG. 17 is a rear view schematically illustrating a pallet body of another embodiment.

FIG. 17 is a rear view schematically illustrating a pallet body 12C of another embodiment. As illustrated in FIG. 17, one elastically deformable holding portion 129C, may be formed, that protrudes into the insertion hole 128. In this way, the shaft 111 can be interposed between the holding portion 129C and the two wall surfaces 1271 and 1272, allowing the pallet body 12C to be positioned with respect to the pallet staff 11. Alternatively, three or more holding portions may be formed.

The present disclosure also includes a configuration in which no holding portion is formed. In this case, with the shaft 111 pressed against the two wall surfaces 1271 and 1272, the pallet body 12 is interposed between the flange portion 112 and the fixing member 13 and thus positioned with respect to the shaft 111.

In the embodiments described above, the holding portion 129 is substantially L-shaped, but is not limited to this. For example, the holding portion may be shaped in an arch shape, and may have any shape so long as the holding portion is elastically deformable in the direction orthogonal to the axial direction of the shaft.

In the above-described First Embodiment and Second Embodiment, the pallet body 12 or 12A is provided with the first recessed portion 126 or 126A in which the flange portion 112 of the pallet staff 11 is accommodated. However, in addition, a recessed portion in which the fixing member is accommodated may be formed in the second surface of the pallet body. This prevents the fixing member from protruding in the axial direction of the shaft with respect to the pallet body, thus allowing the pallet fork to be further thinned.

In First Embodiment and Second Embodiment described above, the flange portion 112 is accommodated in the first recessed portion 126 or 126A formed on the first surface 120 side of the pallet body 12 or 12A, but is not limited to this. For example, an accommodating recessed portion capable of accommodating the flange portion may be formed on the second surface side, and the flange portion may be accommodated in the accommodating recessed portion. In this case, the fixing member is disposed on the first surface side.

Furthermore, in First Embodiment and Second Embodiment, the flange portion 112 is wholly accommodated in the first recessed portion 126 or 126A with respect to the axial direction of the shaft 111, but is not limited to this. For example, the present disclosure also includes a configuration in which the first recessed portion is formed smaller in the thickness dimension than the thickness dimension of the flange portion, and a part of the flange portion is accommodated in the first recessed portion.

In Third Embodiment described above, the fixing member 13B is accommodated in the first recessed portion 126 formed on the first surface 120 side of the pallet body 12, but is not limited to this. For example, an accommodating recessed portion capable of accommodating the fixing member may be formed on the second surface 121 side, and the fixing member may be accommodated in the accommodating recessed portion. In this case, the flange portion is disposed on the first surface side.

In Third Embodiment described above, the fixing member 13B is wholly accommodated in the first recessed portion 126 with respect to the axial direction of the shaft 111, but is not limited to this. For example, the present disclosure also includes a configuration in which the first recessed portion is formed smaller in the depth dimension than the thickness dimension of the fixing member, and a part of the fixing member is accommodated in the first recessed portion.

In the embodiments described above, the fixing member 13 is press-fitted into the shaft 111, but is not limited to this. For example, the fixing member may be threadedly engaged with the shaft, and any other configuration may be used so long as the pallet body can be interposed between the flange portion and the fixing member. The fixing member 13 is shaped like a circular ring, but is not limited to this. For example, the fixing member may have a C-shape or the like. Furthermore, the fixing member 13 need not necessarily be made of metal, but of, for example, resin.

In the embodiments described above, a case has been illustrated in which one pallet body 12 or 12A is manufactured from one silicon substrate 20 or 20A, but the present disclosure is not limited to this case. A plurality of the pallet fork bodies may be manufactured from one silicon substrate.

In the embodiments described above, the pallet body 12 or 12A is a component made of single crystal silicon, but is not limited to this. For example, the pallet body may be a component made of polycrystalline silicon, and may be formed from a substrate containing silicon.

In the embodiments described above, the watch component is illustrated as the pallet fork 10, 10A, or 10B, but is not limited to this. The watch component may be, for example, a crown wheel. One of these types of watch components may be independently mounted in the movement, or a combination of two or more of these types of watch components may be mounted in the movement.

What is claimed is:

1. A watch component comprising:

a shaft member including a shaft and a flange portion provided to protrude in a direction intersecting with an axial direction of the shaft;

a body portion made of silicon and provided with an insertion hole through which the shaft is inserted; and a fixing member mounted on the shaft at a side of the body portion opposite from the flange portion, wherein the body portion includes an accommodating recessed portion configured to accommodate the flange portion, and is fixed to the shaft member by being interposed between the flange portion and the fixing member.

2. A watch component comprising:

a shaft member including a shaft and a flange portion provided to protrude in a direction intersecting with an axial direction of the shaft;

a body portion made of silicon and provided with an insertion hole through which the shaft is inserted; and a fixing member mounted on the shaft at a side of the body portion opposite from the flange portion, wherein the body portion includes an accommodating recessed portion configured to accommodate the fixing member, and is fixed to the shaft member by being interposed between the flange portion and the fixing member.

3. The watch component according to claim 1, wherein the body portion includes a holding portion configured to protrude into the insertion hole and to be elastically deformable in the direction intersecting with the axial direction of the shaft and the body portion and the shaft member are positioned by interposing the shaft between the holding portion and a wall surface of the insertion hole.

4. The watch component according to claim 1, wherein the shaft member is a pallet staff and the body portion is a pallet body including a pallet arm and a pallet rod.

5. A movement comprising the watch component according to claim 1.

6. A watch comprising the movement according to claim 5.

7. A watch component comprising:

a shaft member including:

a shaft; and a flange provided at the shaft, the flange protruding from the shaft in a direction intersecting with an axial direction of the shaft;

a body made of silicon, the body being configured with:

a plurality of arms;

an insertion hole through which the shaft is inserted, the insertion hole being provided at a connection area where ends of the plurality arms are connected; and a recess provided in the body next to the insertion hole; and a fixing member mounted on the shaft at a side of the body opposite from the flange, wherein the recess is configured to accommodate one of the flange or the fixing member, and the body is fixed to the shaft member by being interposed between the flange and the fixing member.

* * * * *